US007065815B2

(12) United States Patent
Buchanan

(10) Patent No.: US 7,065,815 B2
(45) Date of Patent: Jun. 27, 2006

(54) INFLATABLE PADS WITH ADJUSTABLE STATIC HOLD DOWNS

(75) Inventor: Richard Buchanan, Hamburg, NY (US)

(73) Assignee: Gaymar Industries, Inc., Orchard Park, NY (US)

( * ) Notice: Subject to any disclaimer, the term of this patent is extended or adjusted under 35 U.S.C. 154(b) by 12 days.

(21) Appl. No.: 11/005,786

(22) Filed: Dec. 7, 2004

(65) Prior Publication Data

US 2005/0120486 A1 Jun. 9, 2005

Related U.S. Application Data

(60) Provisional application No. 60/527,876, filed on Dec. 8, 2003.

(51) Int. Cl.
*A47C 27/08* (2006.01)

(52) U.S. Cl. ..... 5/691; 5/706

(58) Field of Classification Search ..... 5/691, 5/706, 644, 654, 655.3, 932
See application file for complete search history.

(56) References Cited

U.S. PATENT DOCUMENTS

| | | | | | |
|---|---|---|---|---|---|
| 3,467,081 | A * | 9/1969 | Glass | 601/148 |
| 3,775,781 | A * | 12/1973 | Bruno et al. | 5/607 |
| 4,347,633 | A * | 9/1982 | Gammons et al. | 5/713 |
| 4,454,615 | A | 6/1984 | Whitney | |
| 4,472,847 | A * | 9/1984 | Gammons et al. | 5/713 |
| 4,483,030 | A * | 11/1984 | Flick et al. | 5/691 |
| 4,977,629 | A * | 12/1990 | Jones | 5/632 |
| 5,092,007 | A * | 3/1992 | Hasty | 5/715 |
| 5,097,552 | A * | 3/1992 | Viesturs | 5/691 |
| 5,103,518 | A * | 4/1992 | Gilroy et al. | 5/713 |
| 5,265,293 | A * | 11/1993 | Spahn et al. | 5/706 |
| 5,375,273 | A * | 12/1994 | Bodine et al. | 5/710 |
| 5,701,622 | A * | 12/1997 | Biggie et al. | 5/713 |
| 5,745,942 | A * | 5/1998 | Wilkerson | 5/715 |
| 5,956,787 | A * | 9/1999 | James et al. | 5/713 |
| 6,016,582 | A * | 1/2000 | Larson | 5/691 |
| 6,085,372 | A * | 7/2000 | James et al. | 5/713 |
| 2005/0120486 | A1 * | 6/2005 | Buchanan | 5/706 |

* cited by examiner

*Primary Examiner*—Robert G. Santos
(74) *Attorney, Agent, or Firm*—Roach Brown McCarthy & Gruber P.C.; Kevin D. McCarthy

(57) ABSTRACT

The present invention is directed to a mattress overlay being an inflatable body support formed from a pair of plastic sheets joined together to form a non-inflatable periphery. The non-inflatable periphery defines an air pressurizable chamber therebetween. The chamber provides an air cushion for supporting a person positioned thereatop that dissipates at least pressure to decrease the onset of pressure sores and ulcers. The periphery has a distal end, a proximal end, a first side and a second side. The improvement of the present invention relates to the corner strap system. There is at least one non-inflatable corner strap system that extends from at least one end of the periphery. A center section, at least two side sections positioned on opposite sides of the center section, and a hold down section having at least two elbow-shaped slits or perforations positioned between the center section and each side section form the first non-inflatable corner strap system. Each perforation and slit defines a hold down. Each hold down on each side of the center section is a distinct distance from the center section. The various combinations of hold downs can be used to secure the mattress overlay onto various sized and styles of mattresses.

12 Claims, 2 Drawing Sheets

INFLATABLE PADS WITH ADJUSTABLE STATIC HOLD DOWNS

CLAIM OF PRIORITY

This application claims priority to U.S. provisional patent application Ser. No. 60/527,876; that was filed on Dec. 8, 2003.

FIELD OF THE INVENTION

The present invention relates to a pad having adjustable straps.

BACKGROUND OF THE INVENTION

Since at least 1984, Gaymar has made its duo•gard® mattress overlay. The duo•gard mattress overlay is described in Gaymar's brochure as follows:

"The 2-layer static air design allows for a lower per patient cost for pressure ulcer protection. duo•gard provides prevention and partial thickness pressure ulcer treatment, cost-effectively combining ease-of-use and durability. A durable vinyl construction resists wear and tear and easily wipes clean. Corner straps safely secure the cushion to the mattress. Several inflation options offer quick, easy inflation. The cushion provides a comfortable, safe, low-profile air surface for restful sleep and simple patient ingress and egress."

The duo•gard mattress overlay 10, as illustrated in FIGS. 1 and 2, has at least a first polymeric sheet 12 and a second polymeric sheet 14. The first sheet and the second sheet are joined together at the periphery 16 to form an inflatable section 18. Within the inflatable section 18 can be welds 20 that join the first and second sheets together. The periphery 16 is an uninflated area that is not surrounded by an inflatable section.

The periphery 16 can be described as having a distal end 22, a proximal end 24, a first side 26, and a second side 28. Extending from each end 22, 24 is a corner strap system 30*a,b*.

Each corner strap system 30 has one strap 32*a,b,c,d* extending from each side 26, 28, and shaped like an elbow joint to interconnect with an end, center periphery extension 34*a,b*. This system 30 allows the duo•gard mattress overlay to be able to secure to a mattress.

This corner strap system 30, however, has some problems. First, the corner strap system 30 is a static system. By a static system we mean the straps are unable to be re-positioned to obtain different lengths. By re-positioning the straps, the mattress overlay can be more securely attached to various designs and shapes of mattresses. Examples of such re-position systems are disclosed in U.S. Pat. No. 5,265,293.

In the '293 patent, the straps for the mattress overlays require (1) tabs with at least one aperture positioned (a) along or near each end of a side edge and (b) at the end, center periphery extension of the mattress overlay, (2) special fastening means or buttons, and (3) independent and distinct straps. The independent and distinct straps are interconnected to the tabs of the mattress overlay through buttons or special fasteners. In other words, the '293 patent has numerous removable equipment that is known to get lost or break. When such mishaps occur, the mattress overlay is unable to securely attach to the mattress.

The present invention sets forth an adjustable static system that solves the above problems.

SUMMARY OF THE INVENTION

The present invention is directed to a mattress overlay being an inflatable body support formed from a pair of plastic sheets joined together to form a non-inflatable periphery. The non-inflatable periphery defines an air pressurizable chamber therebetween. The chamber provides an air cushion for supporting a person positioned thereatop that dissipates at least pressure to decrease the onset of pressure sores and ulcers. The periphery has a distal end, a proximal end, a first side and a second side. The improvement of the present invention relates to the corner strap system. There is at least one non-inflatable corner strap system that extends from at least one end of the periphery. A center section, at least two side sections positioned on opposite sides of the center section, and a hold down section having at least two elbow-shaped slits or perforations positioned between the center section and each side section form the first non-inflatable corner strap system. Each perforation and slit defines a hold down. Each hold down on each side of the center section is a distinct distance from the center section. The various combinations of hold downs can be used to secure the mattress overlay onto various sized and styles of mattresses.

DETAILED DESCRIPTION OF THE INVENTION

Figure 1:
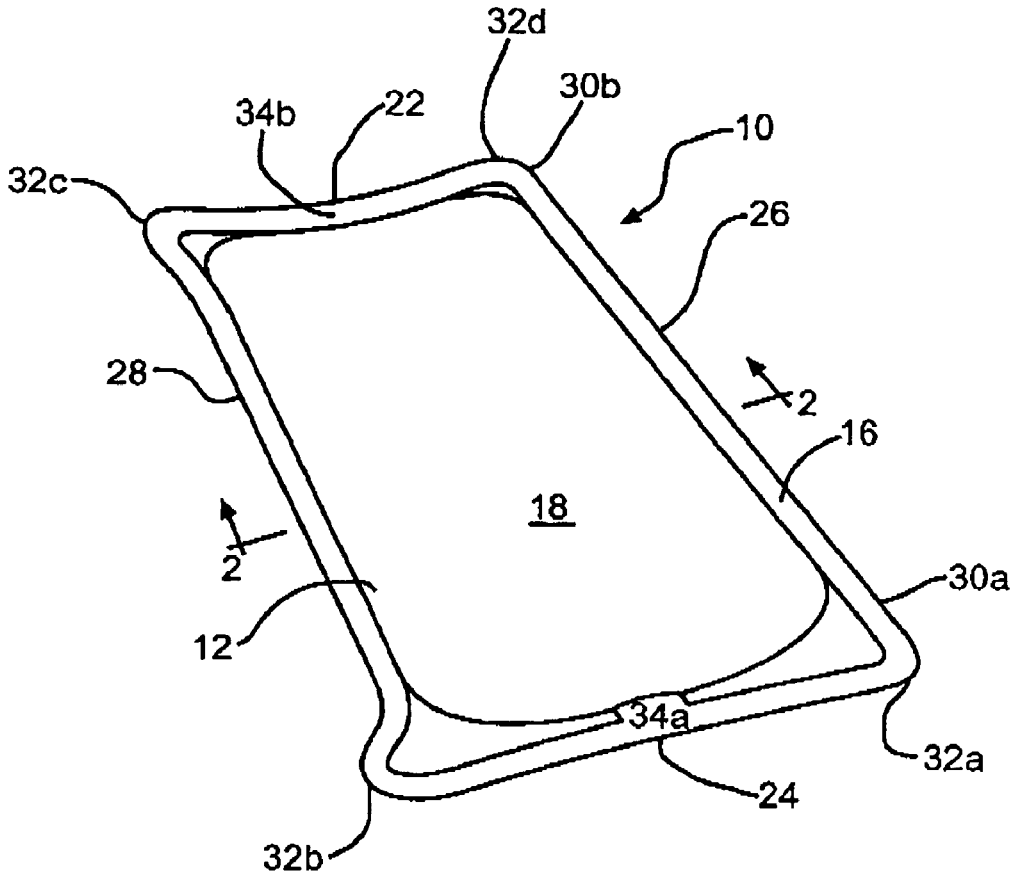
FIG. 1 (Prior Art)
FIG. 1 is an embodiment of the prior art made by the applicant since at least 1984.
Figure 2:
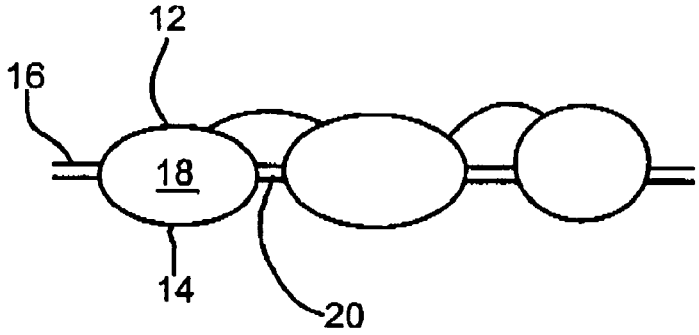
FIG. 2 (Prior Art)
FIG. 2 is a view of FIG. 1 taken along the lines 1—1.

The present invention is directed to a novel strap system 50 for a mattress overlay 10. The mattress overlay 10 has at least a first polymeric sheet 12 and a second polymeric sheet 14. The first sheet and the second sheet are joined together at the periphery 16 to form an inflatable section 18. Within the inflatable section 18 can be welds 20 that join the first and second sheets together. The periphery 16 is an uninflated area that is not surrounded by an inflatable section.

The periphery 16 can be described as having a distal end 22, a proximal end 24, a first side 26, and a second side 28. Extending from each end 22, 24 is the corner strap system 50.

Figure 3:
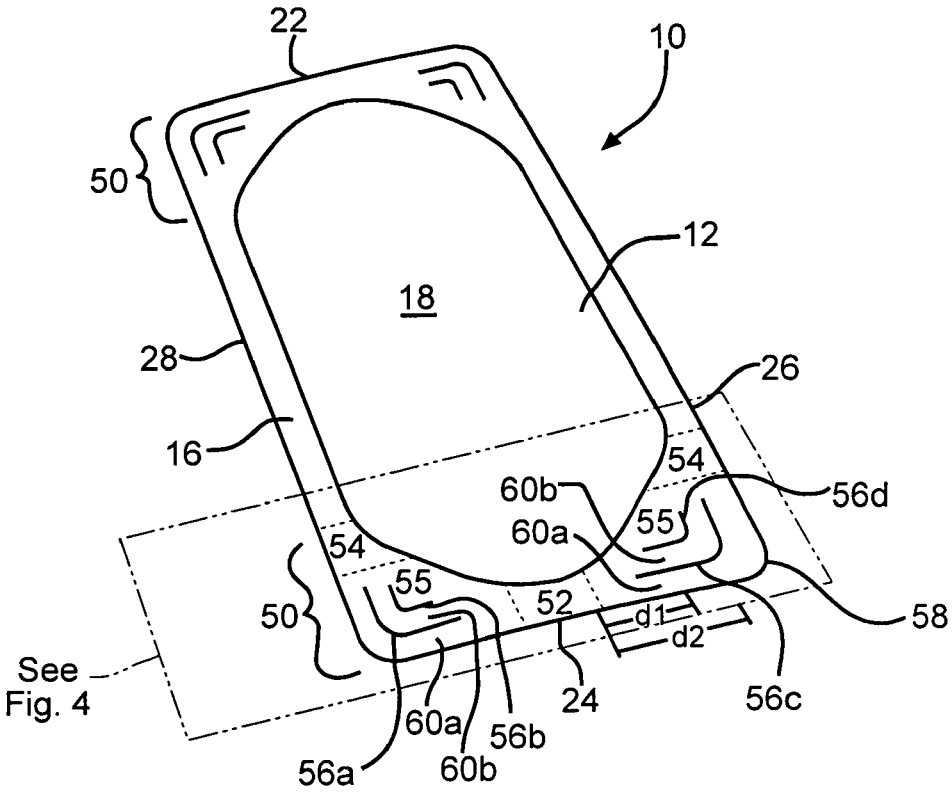
FIG. 3 is view of the present invention.

Each corner strap system 50 is an extension of the non-inflatable periphery 16, and has a center section 52, at least two side sections 54, and at least two hold down sections 55. Each hold down section is positioned between the center section 52 and one side section 54. Within each hold down section is at least two elbow-shaped perforations 56*a,b,c,d*. These perforations positioned between the center section and at least one side section form at least two hold downs 60*a,b*. Each hold down, on each side of the center section, is distinct distance (d1, d2) from the center section 52. Alternatively, the perforations 56 may be slits which means the hold downs are already formed without the user having form the hold downs. Preferably, each corner strap system has mirror image hold downs 60, as shown in FIG. 3.

By having multiple hold downs 60 on each corner strap system 50 and at differing distances (d1, d2) from the center section 52, the mattress overlay 10 is able to be secured to various and differing mattress sizes and styles without additional equipment.

Figure 4:
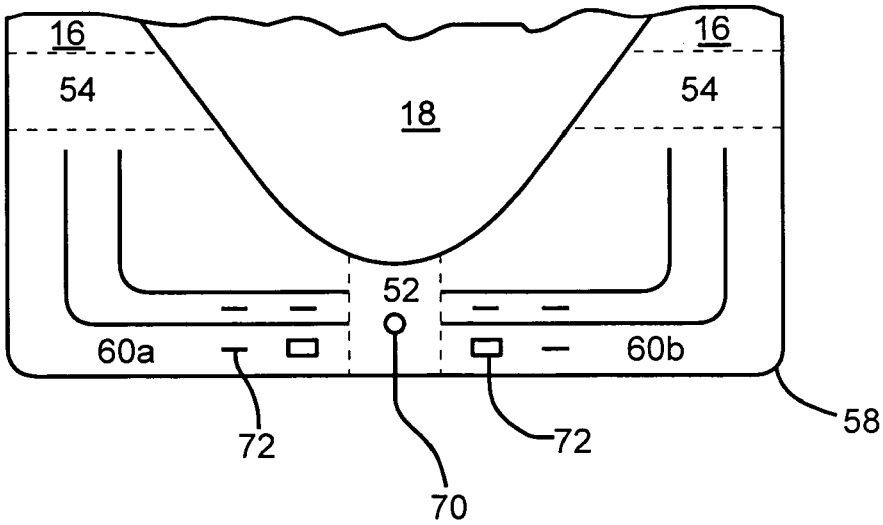
FIG. 4 is an alternative embodiment of the present invention taken from box 4.

In another embodiment illustrated in FIG. 4, the present invention has an attachment device 70 positioned on the center section 52. The attachment device 70 can be any device that can secure the hold down to the center section. Examples of such attachment devices 70 include and are not limited to buttons, studs, snap button devices, hook and loop devices. In addition to the attachment device 70, the hold downs 60 can have a corresponding attachment device 72. The corresponding attachment device 72 can be slits, hook and loop devices, or snap button units. Each corresponding attachment device 72 is capable of being positioned and secured with the attachment device 70. That way, the straps 60, 32 can be re-positioned without any additional removable equipment.

The corner strap system 50 makes the mattress overlay 10 appears rectangular, with rounded corners 58. The center section 52 and the at least two side sections 54*a,b* do not contain perforation or slits, other than to contain the attachment device 70 in the center section 52. These sections are not perforated to provide strength to the corner strap system 50.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected. Materials of construction and techniques of construction of the preferred embodiment, as well as the general design of the preferred embodiment, other than the improvements that are the present invention, are the same as those of the duo•gard mattress overlay described in the Background of the Invention.

The invention claimed is:

1. A mattress overlay being an inflatable body support formed from a pair of plastic sheets joined together to form a non-inflatable periphery, and the non-inflatable periphery defines an air pressurizable chamber therebetween, thereby providing an air cushion for supporting a person positioned thereatop that dissipates at least pressure to decrease the onset of pressure sores and ulcers, the periphery has a distal end, a proximal end, a first side and a second side, the improvement which comprises:

a first non-inflatable corner strap system that extends from at least one end of the periphery;

a center section, at least two side sections positioned on opposite sides of the center section, and a hold down section having at least two elbow-shaped slits or perforations positioned between the center section and each side section to form the first non-inflatable corner strap system;

each elbow-shaped perforation and slit defines a hold down;

each hold down on each side of the center section is a distinct distance from the center section;

the hold downs are used to secure the mattress overlay onto various sized and styles of mattresses.

2. The mattress overlay of claim 1 wherein a second non-inflatable corner strap system is positioned on the other end of the mattress overlay.

3. The mattress overlay of claim 1 wherein at least one of the slits or perforations are parallel to at least the perimeter of the hold down section.

4. The mattress overlay of claim 1 wherein the center section has a button.

5. The mattress overlay of claim 4 wherein at least one hold down on each side of the center section has at least one slit or other attachment mechanism to connect with the button.

6. The mattress overlay of claim 1 wherein the perimeter of the corner strap system makes the mattress overlay appear to be rectangular.

7. A mattress overlay being an inflatable body support formed from a pair of plastic sheets joined together to form a non-inflatable periphery, and the non-inflatable periphery defines an air pressurizable chamber therebetween, thereby providing an air cushion for supporting a person positioned thereatop that dissipates at least pressure to decrease the onset of pressure sores and ulcers, the periphery has a distal end, a proximal end, a first side and a second side, the improvement which comprises:

a first non-inflatable corner strap system that extends from at least one end of the periphery;

a center section having an attachment device, at least two side sections positioned on opposite sides of the center section, and a hold down section having at least two elbow-shaped slits or perforations positioned between the center section and each side section to form the first non-inflatable corner strap system;

each elbow-shaped perforation and slit defines a hold down;

each hold down on each side of the center section is a distinct distance from the center section and has a catch apparatus to secure to the attachment device;

the hold downs are used to secure the mattress overlay onto various sized and styles of mattresses.

8. The mattress overlay of claim 7 wherein a second non-inflatable corner strap system is positioned on the other end of the mattress overlay.

9. The mattress overlay of claim 7 wherein at least one of the slits or perforations are parallel to at least the perimeter of the hold down section.

10. The mattress overlay of claim 7 wherein the attachment device is a button, a stud, snap button, or one portion of a hook and loop unit.

11. The mattress overlay of claim 10 wherein the catch apparatus has at least one slit to connect with the button or stud, a corresponding unit to a snap button or a corresponding other portion of the hook and loop unit.

12. The mattress overlay of claim 7 wherein the perimeter of the corner strap system makes the mattress overlay appear to be rectangular.

* * * * *